US007065842B2

(12) United States Patent
Haglöf

(10) Patent No.: US 7,065,842 B2
(45) Date of Patent: Jun. 27, 2006

(54) ARRANGEMENT OF A STRAP WITH A SLIDABLE RING-SHAPED HOLDER

(76) Inventor: Börje Haglöf, Fyrspannsvägen 70, S-131 48 Nacka (SE)

( * ) Notice: Subject to any disclaimer, the term of this patent is extended or adjusted under 35 U.S.C. 154(b) by 57 days.

(21) Appl. No.: 10/495,444

(22) PCT Filed: Nov. 15, 2002

(86) PCT No.: PCT/SE02/02078

§ 371 (c)(1),
(2), (4) Date: May 12, 2004

(87) PCT Pub. No.: WO03/043458

PCT Pub. Date: May 30, 2003

(65) Prior Publication Data

US 2005/0066483 A1 Mar. 31, 2005

(30) Foreign Application Priority Data

Nov. 19, 2001 (SE) ..... 0103866

(51) Int. Cl.
*A44B 18/00* (2006.01)

(52) U.S. Cl. ..... 24/306; 24/442

(58) Field of Classification Search ..... 24/30.5 R, 24/191, 193, 265 R, 197, 306, 442, 265 WS; 2/311–322, 338; 224/150, 152, 164–178, 224/267

See application file for complete search history.

(56) References Cited

U.S. PATENT DOCUMENTS 3,747,171 A * 7/1973 Montague, Jr. ..... 24/265 WS
3,905,046 A 9/1975 Hirsch
3,934,848 A * 1/1976 Snyder ..... 244/151 A
4,054,952 A * 10/1977 Swallow ..... 2/338
4,203,167 A * 5/1980 Collins ..... 2/322
4,386,723 A * 6/1983 Mule ..... 244/150
5,086,758 A * 2/1992 Schiek et al. ..... 2/338
6,449,815 B1 * 9/2002 Spiller ..... 24/306

FOREIGN PATENT DOCUMENTS

| | | |
|---|---|---|
| FR | 2570581 | 3/1986 |
| SE | 462074 | 5/1990 |
| WO | WO 94/03078 | 2/1994 |
| WO | WO 98/44818 | 10/1998 |

* cited by examiner

*Primary Examiner*—J J Swann
(74) *Attorney, Agent, or Firm*—Frishauf, Holtz, Goodman & Chick, P.C.

(57) ABSTRACT

The invention relates to an arrangement of a watch wrist strap, belt or similar band with an adjustable buckle (1) and a slidable, ring-shaped holder (3). In order to prevent the holder from sliding in an uncontrollable way the bottom side of the band connected with the buckle (1) is provided with a strip of a one member (5), preferably the female member, of a VELCRO fastening means, and the interior of the bottom part of the holder (3) is provided with a part of the other member (6) , the male member, of the VELCRO fastening means. This makes the holder (3) attachable in a detachable way along said one member (5) of the VELCRO fastening means. In order to prevent the female member (5) from being thorn off from the band when the male member (6) is detached from the female member (5), the band is composed of two parts joined towards each other, an upper layer (2*a*) and a bottom layer (2*b*), which latter is provided with an elongated aperture (7), in which the female member (5) is inserted applied against and fixedly attached to the bottom side of the upper layer (2*a*).

7 Claims, 1 Drawing Sheet

ARRANGEMENT OF A STRAP WITH A SLIDABLE RING-SHAPED HOLDER

FIELD OF THE INVENTION

The present invention relates to an arrangement of a watch wrist strap, belt or similar band with an adjustable buckle and a slidable, ring-shaped holder intended to keep the free end portion of the band in position alongside the band, wherein mating male and female members respectively of a VELCRO® fastening means are attached to the interior of the bottom part of the movable ring-shaped holder and to the back of the band along at least the part of the band where the movable ring-shaped holder normally is supposed to be positioned in use of the band.

This application is a U.S. National Phase Application under 35 USC 371 of International Application PCT/SE02/02078 filed Nov. 15, 2002.

BACKGROUND OF THE INVENTION

With priorly known arrangements of similar kind, but without VELCRO bands, it often happens that the ring-shaped holder slides off from the free end portion of the band such that said free end portion becomes free to stick out from the band in an inconvenient way and with the consequence that the buckle might become unbuckled. Even if the movable holder initially is dimensioned to slide in a stiff way, experience has shown that this quality is lost after some time of use, and the holder becomes smooth-sliding.

The Swedish patent specification 462 074 discloses a device for preventing the movable holder from sliding off the free end portion of the band. The top side of the free band portion and the interior of the upper part of the movable holder are provided with magnetically attracting members. Hence, the movable holder will adhere to the free end portion of the band irrespective of the length of the free end portion of the band. If the band is a belt, and the belt is hung up by the buckle, the movable holder normally will slide down along the belt, but will not get lost, because the holder will get stuck to the free end portion of the belt. This known device, accordingly, has many valuable qualities, but the magnetic members proved to be subject to hard mechanical wear at the use of the band or belt, which resulted in an evident tendency of the magnetic members to come loose. Moreover, the solution with magnetic members is incredibly expensive.

A better solution of the present problem is known by SE 9701321-3, where a desired adjustment of the movable holder in an optional position is achieved by the arrangement of above mentioned VELCRO band. An obvious advantage with this known arrangement is the fact, that when the movable holder once has been positioned in a desired position it will stay there and the free end portion of the band is permitted to slide freely into and out from the holder at locking and releasing the band by the buckle.

Only at adjustment of the buckle it is necessary to loosen the holder, move it and attache it by means of the VELCRO band. It has proved, however, that adhesion force of the VELCRO members is so strong that it might occur that the VELCRO member attached to the band is thorn off from the band, especially if the holder is positioned close to the ends of the VELCRO member attached to the band.

OBJECT OF THE INVENTION

There is a great demand for a solution of the problem to get the movable holder stuck to the free end portion of the band, and it is an object of the present invention to achieve such a solution that the inconveniences of the known devices are eliminated.

SUMMARY OF THE INVENTION

To achieve the object of the invention, an apparatus is provided which includes a band including an upper layer and a bottom layer, an adjustable buckle for securing the band into a loop, and a ring-shaped holder for holding a free end portion of the band when the band is buckled into the loop. A hook and loop fastener, which includes a hook member and a loop member, couples the ring-shaped holder to the band. The bottom layer of the band has an elongated aperture formed therein that extends at least along a portion of the band where the ring-shaped holder is adapted to be positioned to hold the free end portion of the band. One of the hook member and the loop member of the hook and loop fastener is provided in the elongated aperture and attached to the upper layer of the band so as to be positioned on an interior of the band while the band is buckled in the loop. And the other of the hook member and the loop member is provided on an interior surface of the ring-shaped holder so as to be attachable to the one of the hook member and the loop member that is provided on the band. Due to the fact that one of the hook and loop members is countersunk in the elongated aperture of the bottom layer of the band and is attached to the surface of the upper layer, the edges of the aperture will protect the edges of the countersunk member. This applies especially to the ends of the hook or loop member, which are protected from being scraped off.

The hook member or the loop member exposed in the elongated aperture has two end portions, which are sandwiched between the upper and the bottom layers of the band.

The hook member or the loop member exposed in the elongated aperture is a female member, which, as is well known, has closed loops which differ from the hooks of the male members and, thus, has a soft velvet structure that cannot produce a disturbing effect upon a surface consisting of skin or textiles.

BRIEF DESCRIPTION OF THE DRAWINGS

The invention is explained in more detail in the following description with reference to the attached drawing, which shoes, by way of example, an embodiment of an arrangement according to the invention, and in which.

DETAILED DESCRIPTION

Figure 1:
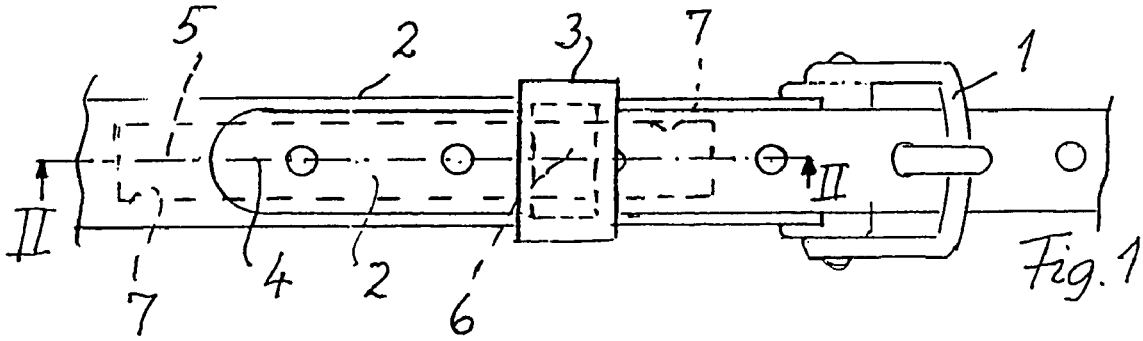
FIG. 1 is a plan view of a watch wrist strap made of leather and provided with a buckle.
Figure 2:
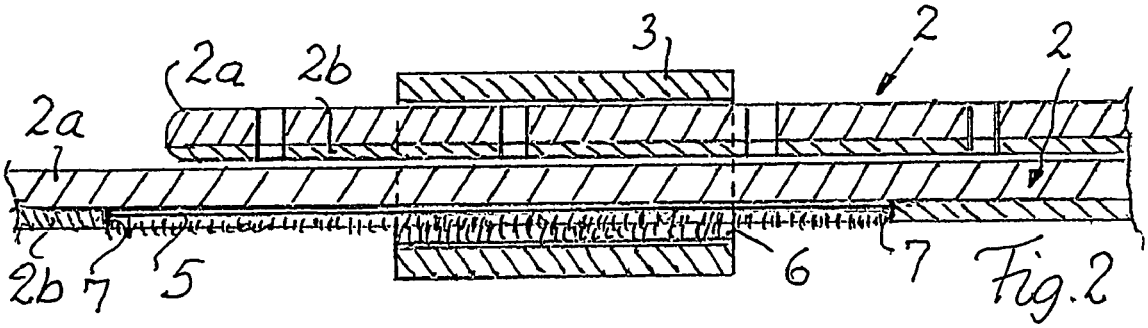
FIG. 2 is a longitudinal sectional view of a portion of the strap shown in FIG. 1 along the line II in FIG. 1.

FIG. 1 shows the watch wrist strap 2 provided with a buckle 1. The free end portion 4 of the strap extends through a movable ring-shaped holder 3, which keeps the free end 4 of the strap in place alongside the top side of the strap 2. The strap 2 includes two layers, an upper layer 2*a* and a bottom layer 2*b*, which are joined by stitching along the strap edges. The bottom layer 2*b* has an elongated aperture 7 in which the female member 5 (loop member) of a VELCRO band (hook and loop fastener) is fitted. The female member 5 is glued to the bottom side of the upper layer 2*a*. The aperture 7 and the female member 5 extend from a part of the strap 2 close to the buckle 1 to a part where the free end 4 normally might be positioned when furthest away from the buckle. The male member 6 (hook member) of the VELCRO band is attached to the interior of the bottom part of the holder 3. The male member 6 is essentially wider than the female member 5, which for self-evident reasons has a limited width. The male member 6 is glued to the interior of the holder 3, and may also be stitched because the bottom side of the holder is not visible in use. The holder 3 is shown in FIG. 2 as being moved to the free end portion 4 where the male member 6 of the holder is attached to the female member 5 of the strap 2 by the pressure of the strap 2 against the bottom part of the holder, which contacts the wrist of the user. In connection with loosening of the strap the free end portion 4 is pulled out from the holder 3 and after disconnection from the buckle 1 permitted to slide out from the buckle. At repeated attachment of the strap, the free end portion 4 is pushed through the buckle 1 and locked by this, after which the free end portion is moved into the holder 3, which already has the correct position after the previous adjustment.

At a change of the position of the holder 3 the VELCRO band attachment is disconnected by applying pressure to the holder in the longitudinal direction of the strap until disconnection occurs, after which the holder is moved to a new position where the male member 6 is permitted to get stuck to the female member 5.

VELCRO bands are usually made of polyamide plastics with very fine qualities and dimensions and are very durable. The female member of the VELCRO band has very small loops and a structure similar to pure velvet, such that the female member can bear on the wrist without causing irritations of any kind. The male member has hooks with a somewhat rougher structure and therefore are suitably used in the interior of the holder 3, where it cannot get in contact with the skin or get dirty.

Figure 3:
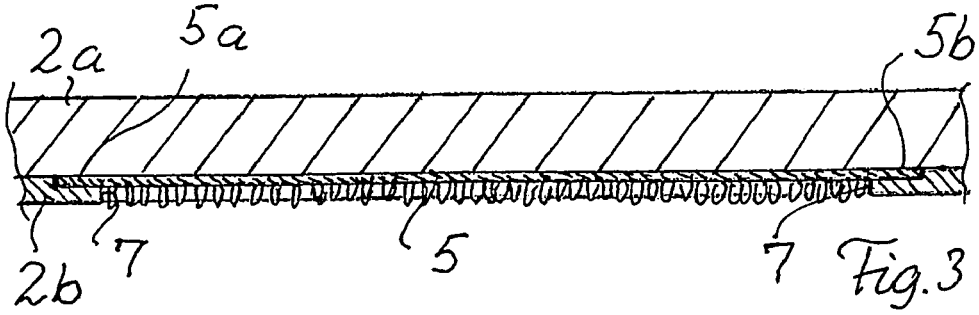
FIG. 3 is a longitudinal sectional view of a modification of the bottom part of the band in FIG. 2.

The two members 5,6 of the VELCRO band can be glued to the band and holder, but to ensure a safe attachment the glue joint may be completed by lengthening a bit of at least the ends 5*a*,5*b* of the female member 5, as shown in FIG. 3. The ends 5*a*,5*b* extend in between the layers 2*a*,2*b* of the strap 2 and are glued to both of sayers. Also the side edges of the female member 5 may extend a bit in between the layers 2*a* and 2*b* and may be glued to both of said layers and may also suitably be secured by the two decorative seams that normally are provided along the edges of especially a watch wrist strap.

The invention is of course not restricted to the embodiment here shown and described but can be modified in different ways within the scope of the arrangement defined by the appended claims. Hence, the female member of the VELCRO fastening means can be example, especially on belts, comprise a line of the separate parts with suitable interspaces for forming a long member with moderate consumption of material.

The invention claimed is:

1. An apparatus comprising:

a band comprising an upper layer and a bottom layer;

an adjustable buckle for securing the band into a loop;

a ring-shaped holder for holding a free end portion of the band when the band is buckled into the loop;

a hook and loop fastener which couples the ring-shaped holder to the band, said hook and loop fastener comprising a hook member and a loop member;

wherein the bottom layer of the band has an elongated aperture formed therein that extends at least along a portion of the band where the ring-shaped holder is adapted to be positioned to hold the free end portion of the band; and wherein one of the hook member and the loop member of the hook and loop fastener is provided in the elongated aperture and attached to the upper layer of the band so as to be positioned on an interior of the band while the band is buckled in the loop, and the other of the hook member and the loop member is provided on an interior surface of the ring-shaped holder so as to be attachable to said one of the hook member and the loop member that is provided on the band.

2. The apparatus according to claim 1, wherein end portions of said one of the hook member and the loop member are sandwiched between the upper bottom layers of the band.

3. The aperture according to claim 1, wherein the loop member is provided in the elongated aperture and attached to the upper layer of the band.

4. The apparatus according to claim 2, wherein the loop member is provided in the elongated aperture and attached to the upper layer of the band.

5. The apparatus according to claim 1, wherein the ring-shaped holder is slidable along the band to be moved to a desired attachment position on the band.

6. The apparatus according to claim 1, wherein the band comprises a wrist band of a watch.

7. The apparatus according to claim 1, wherein the band comprises a belt.

* * * * *